US006255920B1

(12) United States Patent
Ohwada et al.

(10) Patent No.: US 6,255,920 B1
(45) Date of Patent: Jul. 3, 2001

(54) LOW-PASS FILTER

(75) Inventors: Tetsu Ohwada; Moriyasu Miyazaki; Kazuhiro Mukai, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/350,905

(22) Filed: Jul. 12, 1999

(30) Foreign Application Priority Data

Nov. 12, 1998 (JP) ..... 10-322521

(51) Int. Cl.[7] ..... H01P 1/20; H01P 3/06

(52) U.S. Cl. ..... 333/206; 333/81 A; 333/202; 333/246

(58) Field of Search ..... 333/206, 244, 333/81 A, 246, 204, 238, 161, 202

(56) References Cited

U.S. PATENT DOCUMENTS

| | | | |
|---|---|---|---|
| 2,183,123 | * 12/1939 | Mason | 333/202 |
| 3,875,538 | 4/1975 | Minet et al. . | |
| 3,879,690 | 4/1975 | Golant et al. . | |
| 4,288,766 | 9/1981 | Okita . | |
| 4,472,695 | 9/1984 | Beauquet et al. . | |

FOREIGN PATENT DOCUMENTS

| | | |
|---|---|---|
| 4710517 | 4/1972 | (JP) . |
| 57-123701 | 8/1982 | (JP) . |
| 1162903 | 11/1989 | (JP) . |
| 5029803 | 2/1993 | (JP) . |
| 7235803 | 9/1995 | (JP) . |

OTHER PUBLICATIONS

Matthaei, G.L., et al., "Microwave Filters, Impedance-Matching Networks, and Coupling Structures", McGraw Hill Book Co., Inc., 1964, Sec. 7.03 Low–Pass Filters Using Semi–Lumped Elements, pp. 365–374.

* cited by examiner

*Primary Examiner*—Benny Kee
*Assistant Examiner*—Kimberly E Glenn
(74) *Attorney, Agent, or Firm*—Rothwell, Figg, Ernst & Manbeck

(57) ABSTRACT

A low-pass filter includes metal stub conductors mounted on a signal conductor at midpoints of adjacent high impedance sections of the signal conductor. The metal stub conductors prevent the occurrence of resonance between the high impedance sections, thereby providing a large attenuation value over a wide frequency band above the cutoff frequency of the low-pass filter.

5 Claims, 6 Drawing Sheets

LOW-PASS FILTER

BACKGROUND OF THE INVENTION

1. Field of the Invention

The present invention relates generally to a low-pass filter that is used to attenuate high-frequency components in VHF, UHF, microwave and milliwave bands and, more particularly, to a low-pass filter of the type that has a ground and a signal conductor, such as a coaxial line filter or a stripline filter.

2. Description of the Prior Art

FIG. 1 is a partly exploded, perspective view depicting the structure of a conventional coaxial line filter (a low-pass filter) disclosed in G. L. Matthaei et al., "Microwave Filters, Impedance-Matching Networks, and Coupling Structures," pp.365–374, McGrawHill, 1962. Reference numeral 1 denotes a hollow, cylindrical external ground conductor; 2 denotes a columnar or rod-like signal conductor disposed in the external ground conductor 1 along its axis but spaced apart therefrom; 3 denotes an input terminal connected to one end of the signal conductor 2; 4 denotes an output terminal connected to the other end of the signal conductor 2; 5, 6 and 7 denote disc-shaped, capacitive conductors of the same size which are mounted on the signal conductor 2 concentrically therewith at predetermined intervals in such a manner that the signal conductor 2 extends through the capacitive conductors 5, 6 and 7 at the center thereof; and 8, 9 and 10 denote dielectric rings tightly inserted between the perimeters of the capacitive conductors 5, 6 and 7 and the interior wall of the external ground conductor 1.

The coaxial line filter of the above configuration serves, in its entirety, as an LC ladder circuit wherein those parts of the signal conductor 2 having mounted thereon the capacitive conductors 5, 6 and 7 function as low-impedance lines and the other parts as high-impedance lines.

When supplied at the input terminal 3 with a signal of the VHF, UHF, microwave or milliwave band, the coaxial line filter attenuates a signal component above a cut-off frequency fc determined by the LC ladder circuit, permitting the passage therethrough of a signal component below the cut-off frequency fc for output via the output terminal 4. Thus, the coaxial line filter operates as a low-pass filter.

Because of such a configuration as described above, however, the conventional low-pass filter has some drawbacks; for example, in the case of its multi-stage connection, high-impedance lines of a predetermined electric length produce therebetween resonance at a frequency where the phase of the input signal varies by $\pi$ for the length of one of the high-impedance lines. As a result, the low-pass filter permits the passage therethrough of signal components of frequencies around resonance.

FIG. 2 is a graph showing the attenuation characteristic of the traditional coaxial line filter. The abscissa and the ordinate represent signal frequency and attenuation value, respectively. Reference character fc denotes the cut-off frequency and fs denotes the resonance frequency of the high-impedance line. As depicted in FIG. 2, the coaxial line filter exhibits a transmission characteristic at the frequency (the resonance frequency fs) corresponding to the electric length of the high-impedance line, resulting in a failure to provide a large attenuation value over a wide frequency band above the cut-off frequency fc.

SUMMARY OF THE INVENTION

It is therefore an object of the present invention to provide a low-pass filter which has a plurality of stages of high-impedance lines to secure a sharp cut-off characteristic but suppresses the occurrence of resonance between the high-impedance lines, thereby providing a large attenuation value over a wide frequency band above the cut-off frequency.

According to an aspect of the present invention, there is provided a low-pass filter which comprises: a ground conductor; a signal conductor disposed in the ground conductor but spaced apart therefrom; a plurality of capacitive conductors mounted on the signal conductor at predetermined intervals lengthwise thereof to form electric fields higher in intensity than that of the signal conductor between the capacitive conductors and the ground conductor, the plurality of capacitive conductors forming low-impedance lines, respectively, and defining a high-impedance line between each pair of capacitive conductors so that the signal conductor is composed of an alternate arrangement of low- and high-impedance lines; and second capacitive conductors each carried upon the signal conductor in one of the high-impedance lines at the mid-point in its lengthwise direction to form between it and the ground conductor an electric field of an intensity lower than that by each of the capacitive conductors.

With such a low-pass filter, since the signal conductor consists of an alternate arrangement of the high-impedance lines defined by the capacitive conductors therebetween and the low-impedance lines formed by the capacitive conductors themselves, it is possible to achieve excellent attenuation of signals over a wide frequency band above the cut-off frequency that is determined by the alternate arrangement of the high- and low-impedance lines.

In addition, even in the case where the high-impedance lines symmetrically located along the signal conductor have the same electric length and hence produce therebetween resonance at a frequency where the phase of the input signal varies by $\pi$ for the electric length of each high-impedance liner, the second capacitive conductor secured to each high-impedance line at the center thereof ensures effective attenuation of a signal at the resonance frequency. Furthermore, even if the signal of the resonance frequency is not sufficiently attenuated by the second capacitive conductor itself, the energy transmittance of the resonance frequency, which is dependent solely upon the capacitive conductor, can be lowered because the resonance frequency of the signal conductor practically shifts toward the higher-frequency side due to the provision of the second capacitive conductor on the signal conductor for each high-impedance line at the mid-point in its lengthwise direction. Hence, the low-pass filter exhibits a sharp cut-off characteristic at the cut-off frequency by the multistage high-impedance lines and, at the same time, suppresses the occurrence of resonance between the high-impedance lines to thereby provide a large attenuation value over a wide frequency band which is impossible to achieve with the prior art above the cut-off frequency.

According to another aspect of the present invention, the second capacitive conductors are geometrically similar to the first-mentioned capacitive conductors.

Because of their geometrical similarity, the both capacitive conductors can be fabricated by common design criteria. Hence, the additional provision of the second capacitive conductors does not ever require extra time to do so.

According to another aspect of the present invention, there is provided a low-pass filter which comprises: a ground conductor; a signal conductor disposed in the ground conductor but spaced apart therefrom; and a plurality of capacitive conductors mounted on the signal conductor at predetermined intervals lengthwise thereof to form electric fields higher in intensity than that of the signal conductor between the capacitive conductors and the ground conductor, the plurality of capacitive conductors forming low-impedance lines, respectively, and defining a high-impedance line between each pair of capacitive conductors so that the signal conductor is composed of an alternate arrangement of low- and high-impedance lines; and wherein that part of the signal conductor forming at least one of the high-impedance lines has a sectional area different from those of the other parts of the signal conductor forming the other remaining high-impedance lines; and when the sectional area of that part of the signal conductor forming said at least one high-impedance line differs from the sectional area of that part of the signal conductor forming that one of the remaining high-impedance lines located in symmetrical relation to said at least one high-impedance line with respect to the center of the signal conductor, the length of that part of the signal conductor forming said at least one high-impedance line is chosen such that the signal conductor provides the same inductance value at a cut-off frequency in the symmetrically located high-impedance lines.

With such a low-pass filter, since the signal conductor consists of an alternate arrangement of the high-impedance lines defined by the capacitive conductors therebetween and the low-impedance lines formed by the capacitive conductors themselves, it is possible to achieve excellent attenuation of signals over a wide frequency band above the cut-off frequency that is determined by the alternate arrangement of the high- and low-impedance lines.

Besides, the signal conductor have different sectional areas between at least one of the high-impedance lines and the other remaining high-impedance lines. And when the sectional area of that part of the signal conductor corresponding to said at least one high-impedance line differs from the sectional area of that part of the signal conductor corresponding to that one of the remaining high-impedance lines located in symmetrical relation to said at least one high-impedance line with respect to the center of the signal conductor, the length of that part of the signal conductor corresponding to said at least one high-impedance line is chosen such that the signal conductor provides the same inductance value at a cut-off frequency in the symmetrically located high-impedance lines. Accordingly, each high-impedance line has a different frequency at which the phase of the input signal varies by $\pi$ for the electric length of the line. Even if a plurality of such high-impedance lines of different electric lengths are connected, no resonance will occur between them. Further, even when only one pair of symmetrically located high-impedance lines have different electric lengths, the signal of the resonance frequency is surely attenuated in such high-impedance lines. Hence, this filter structure provides a sharp cut-off characteristic at the cut-off frequency by the plural stages of high-impedance lines, while at the same time it suppresses the occurrence of resonance between them, thereby permitting effective attenuation of signals over a wide frequency band which is impossible with the prior art to achieve above the cut-off frequency.

According to another aspect of the present invention, there is provided a low-pass filter which comprises: a flat ground conductor; a signal conductor spaced apart from the ground conductor; and a plurality of capacitive conductors mounted on the signal conductor at predetermined intervals lengthwise thereof, the plurality of capacitive conductors forming low-impedance lines, respectively, and defining a high-impedance line between each pair of capacitive conductors so that the signal conductor is composed of an alternate arrangement of low- and high-impedance lines; and wherein the plurality of capacitive conductors are each composed of an open stub projecting portion of an electric length equal to one-half that of the adjoining one of the high-impedance lines and a rearward projection extending from the signal conductor at the side opposite to the open stub projecting portion.

With such a low-pass filter, since the signal conductor consists of an alternate arrangement of the high-impedance lines defined by the capacitive conductors therebetween and the low-impedance lines formed by the capacitive conductors themselves, it is possible to achieve excellent attenuation of signals over a wide frequency band above the cut-off frequency that is determined by the alternate arrangement of the high- and low-impedance lines.

In addition, since the capacitive conductors are each composed of the open stub projecting portion of an electric length equal to one-half that of the adjoining high-impedance line and the rearward projecting portion extending from the signal conductor at the side opposite to the open stub projecting portion, each of the capacitive conductors and the signal conductor are electrically shorted almost completely at their junction by the action of the open stub projecting portion at the frequency where the phase of the input signal varies by p for the electric length of the high-impedance line concerned. Hence, even if high-impedance lines of the same electric length are connected, there is no possibility that resonance occurs between them. Accordingly, this low-pass filter provides a sharp cut-off characteristic at the cut-off frequency by the plural stages of high-impedance lines, while at the same time it suppresses the occurrence of resonance between them, thereby permitting effective attenuation of signals over a wide frequency band which is impossible with the prior art to achieve above the cut-off frequency.

According to still another aspect of the present invention, the open stub projecting portions and/or rearward projecting portions are bent.

Since the open stub projecting portions and/or rearward projecting portions are bent, they are small in area, permitting miniaturization of a stripline filter.

DETAILED DESCRIPTION OF THE PREFERRED EMBODIMENTS

A detailed description will be given, with reference to the accompanying drawings, of the best mode for carrying out the present invention.

Embodiment 1

Figure 3:
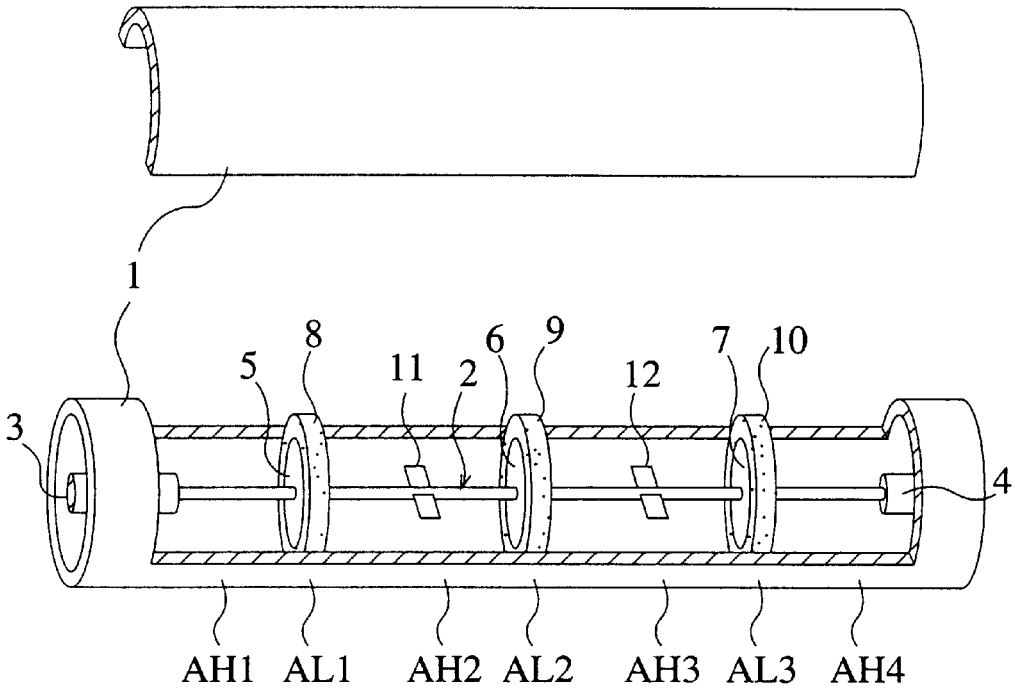
FIG. 3 is a partly exploded, perspective view illustrating the structure of a coaxial line filter according to a first embodiment of the present invention.

FIG. 3 is a partly exploded, perspective view illustrating the configuration of a coaxial line filter (a low-pass filter) according to a first embodiment (Embodiment 1) of the present invention. Reference numeral 1 denotes a hollow cylindrical external ground conductor (a ground conductor); 2 denotes a columnar or rod-like signal conductor disposed in the external ground conductor 1 along its axis but spaced apart therefrom; 3 denotes an input terminal connected to one end of the signal conductor 2; 4 denotes an output terminal connected to the other end of the signal conductor 2; 5, 6 and 7 denote disc-shaped, capacitive conductors of the same size which are mounted on the signal conductor 2 concentrically therewith at predetermined intervals in such a manner that the signal conductor 2 extends through the conductors 5, 6 and 7 at the center thereof; 8, 9 and 10 denote dielectric rings tightly inserted between the perimeters of the capacitive conductors 5, 6 and 7 and the interior wall of the external ground conductor 1; and 11 and 12 denote substantially rectangular thin metal pieces (second capacitive conductors) which are carried upon the signal conductor 2 at the mid-points thereof in those sections defined by the spaced-apart or opposed capacitive conductors (5 and 6, or 6 and 7). Incidentally, the dielectric rings 8, 9 and 10 also serve to hold the signal conductor 2 and the capacitive conductors 5, 6 and 7 at predetermined positions in the external ground conductor 1.

In such a coaxial line filter, the field intensity between the signal conductor 2 disposed in the hollow of the external ground conductor 1 increases with a decrease in the distance between the former and the inner periphery of the latter; this field intensity determines the impedance characteristic of each section of the signal conductor 2. The sections of the signal conductor 2 on which the capacitive conductors 5, 6 and 7 are mounted are large in diameter and covered with the dielectric rings 8, 9 and 10, respectively, so that a very high-intensity electric field is formed in each of these sections; furthermore, its electric length is short as compared with the signal of the cut-off frequency fc. Hence, these sections perform the function equivalent to a parallel connection of capacitive lumped-constant elements at frequencies close to the cut-off frequency fc. On the other hand, the sections of the signal conductor 2 defined by the pairs of first capacitive conductors (5 and 6, 6 and 7) are small in diameter, and current flows toward the conductors, and hence magnetic fluxes center thereon. Consequently, these sections perform the function equivalent to a series connection of inductive lumped-constant elements at the frequencies close to the cut-off frequency.

Figure 4:
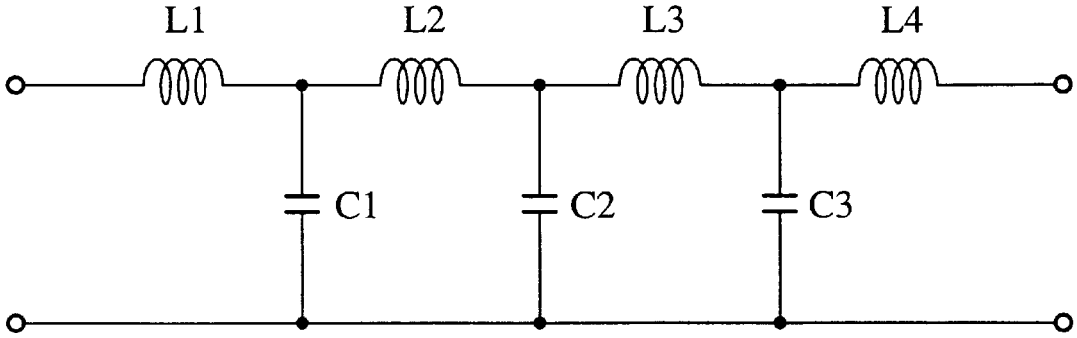
FIG. 4 is an equivalent circuit diagram of the coaxial line filter of the first embodiment at frequencies about its cut-off frequency.

FIG. 4 depicts an equivalent circuit of the coaxial line filter of Embodiment 1 at the frequencies near its cut-off frequency. Reference characters C1, C2 and C3 denote equivalent capacitive elements of low-impedance line sections (AL1, AL2 and AL3 in FIG. 3) where the capacitive conductors 5, 6 and 7 are mounted on the signal conductor 2, respectively; and L1, L2, L3 and L4 denote equivalent inductive elements of high-impedance line sections (AH1, AH2, AH3 and AH4 in FIG. 3) defined by the pairs of capacitive conductors (5 and 6, 6 and 7). Incidentally, the metal pieces 11 and 12 are electrically so small that they hardly cause variations in the characteristic impedance value at the frequencies near the cut-off frequency fc; therefore, they can be ignored at frequencies below the cut-off frequency fc. Thus, the coaxial line filter according to Embodiment 1 operates as a circuit equivalent to a multi-stage (four-stage in this case) LC ladder circuit at frequencies close to the cut-off frequency fc.

Next, the operation of this embodiment will be described below.

When signals of the VHF, UHF, microwave or milliwave band are input into the coaxial line filter via the input terminal 3, the magnitude of each circuit element is not negligible for a signal above the cut-off frequency fc that is determined by the LC ladder circuit, and the signal is attenuated by the influence of the element. As for the signal below the cut-off frequency fc, the magnitude of each element is sufficiently small as compared with the wavelength of the signal and is negligible; hence, the signal is not attenuated but provided intact to the output terminal 4. Accordingly, the coaxial line filter functions as a low-pass filter.

Besides, in Embodiment 1 the high-impedance lines of the pairs (AH1 and AH4, AH2 and AH3) symmetrically located along the signal conductor 2 have the same physical length and hence naturally have the same electric length. In consequence, at the frequency where the phase varies by $\pi$ for the length of one high-impedance line, the low-impedance lines AL1, AL2 and AL3 cause the high-impedance lines to essentially short at both ends, incurring the possibility of resonance occurring between them. That is, the coaxial line filter is likely to permit the passage therethrough of signals around the resonance frequency fs. In Embodiment 1, however, the metal pieces 11 and 12 are each mounted on one of the high-impedance lines AH2 and AH3 at the mid-point in the lengthwise direction thereof. At such a high frequency as the frequency fs of resonance that occurs between the high-impedance lines, the metal pieces 11 and 12 are not negligible in terms of electric magnitude, and function as a parallel-connection of capacitive elements, effectively attenuating the signal of the resonance frequency fs between the high-impedance lines.

Figure 1:
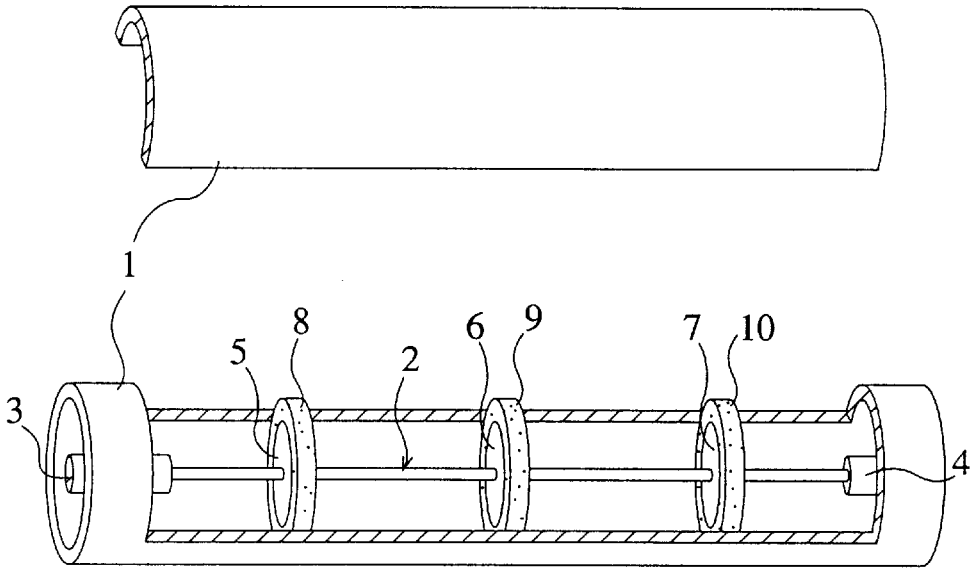
FIG.1(PRIOR ART)
FIG. 1 is a partly exploded, perspective view depicting the structure of a conventional coaxial line filter.
Figure 2:
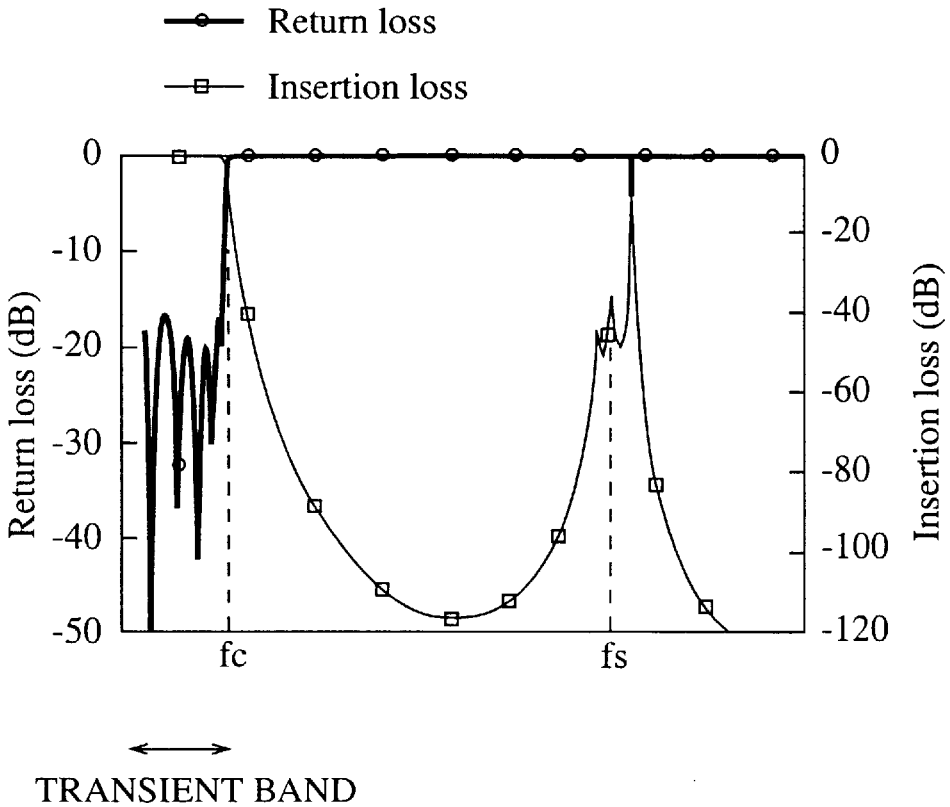
FIG.2(PRIOR ART)
FIG. 2 is a graph showing the attenuation characteristic of the conventional coaxial line filter.
Figure 5:
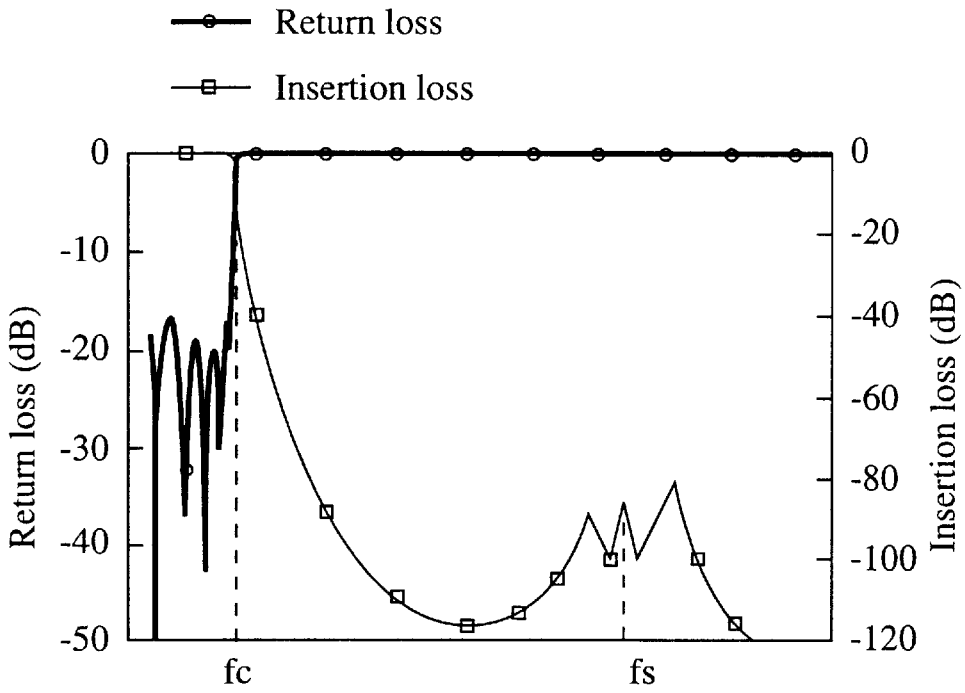
FIG. 5 is a graph showing the attenuation characteristic of the coaxial line filter according to the first embodiment.
Figure 6:
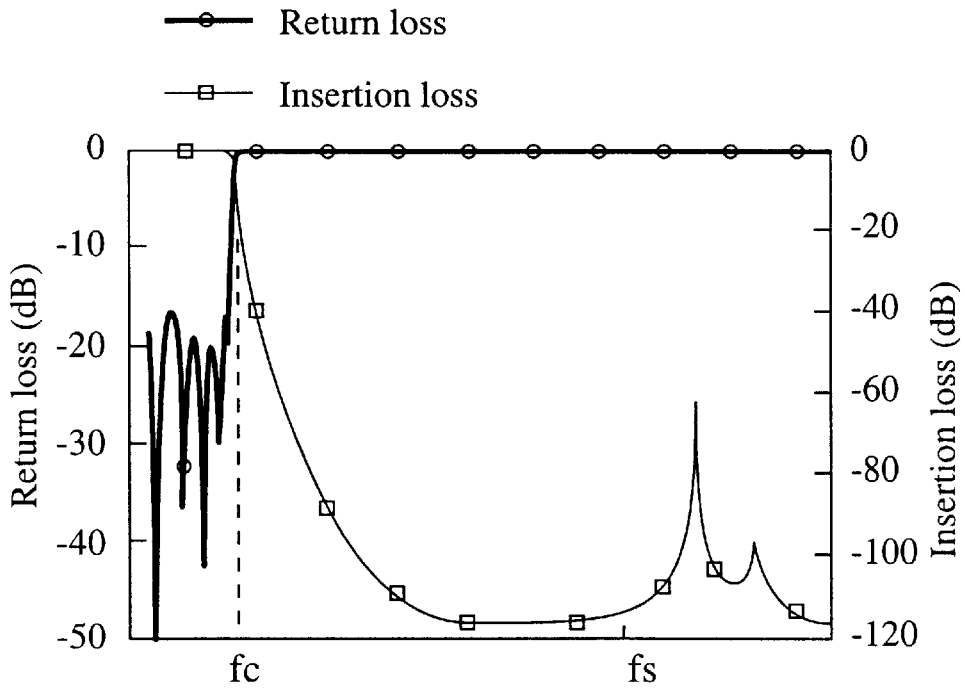
FIG. 6 is a graph showing the attenuation characteristic of the coaxial line filter according to the first embodiment.

FIGS. 5 and 6 are graphs showing the attenuation characteristics of the coaxial line filter according to Embodiment 1. The abscissa and the ordinate represent signal frequency and attenuation value, respectively; fc denotes the cut-off frequency, and fs the resonance frequency of the high-impedance lines. As is evident from the comparison with FIG. 2 which shows the attenuation characteristic of the conventional coaxial line filter, the filter according to Embodiment 1 provides increased attenuation at the resonance frequency fs between the high-impedance lines. Incidentally, FIG. 5 shows the case where the metal pieces 11 and 12 sufficiently function as a parallel connection of capacitive elements at the resonance frequency fs, and FIG. 6 shows the case where the metal pieces 11 and 12 do not sufficiently function as a parallel connection of capacitive elements. In the latter case, the suppression of resonance by the frequency fs is less effective than in the former case; in practice, however, the resonance frequency itself shifts to the frequency at which the metal pieces 11 and 12 function as parallel-connected capacitive elements. At any rate, this suppresses resonance between the high-impedance lines AH1, AH2, AH3 and AH4, making it possible to provide a large attenuation value over a wide frequency band which is impossible with the prior art to achieve above the cut-off frequency fc.

As described above, according to Embodiment 1, there are mounted on the high-impedance lines AH2 and AH3 at midpoints lengthwise thereof the metal pieces 11 and 12 which extend across the signal conductor 2 and form between them and the ground conductor 1 electric fields of lower intensity than those by the capacitive conductors 5, 6 and 7. With this configuration, it is possible to attenuate signals of frequencies higher than the cut-off frequency fc that is determined by the alternate arrangement of the high-impedance lines AH1, AH2, AH3 and AH4 and the low-impedance lines AL1, AL2 and AL3; hence, an excellent attenuation characteristic can be achieved over a wide frequency band.

In addition, the high-impedance lines (AH1 and AH4, AH2 and AH3) symmetrically located along the signal conductor have the same electric length for each pair, and resonance is likely to occur between each pair of high-impedance lines (AH1 and AH4, AH2 and AH3) at the resonance frequency fs where the input signal undergoes a phase shift of p for the electric length of the high-impedance line; however, since the metal pieces 11 and 12 are carried upon the signal conductor 2 at mid-points of the high-impedance lines lengthwise thereof, respectively, the signal of the resonance frequency fs can effectively be attenuated. Furthermore, even if the signal of the resonance frequency fs is not sufficiently attenuated by the metal pieces 11 and 12, the resonance frequency fs of the signal conductor 2 practically shifts toward the higher-frequency side due to the provision of the metal pieces 11 and 12 at the mid-points of the high-impedance lines lengthwise thereof, it is possible to lower the energy transmittance at the resonance frequency fs that is determined by the capacitive conductors 5, 6 and 7 alone.

Thus, the filter structure according to this embodiment ensures the realization of a sharp attenuation characteristic by the high-impedance lines AH1, AH2, AH3 and AH4, but suppresses the occurrence therebetween of resonance, making it possible to provide a large attenuation value over a wide frequency band which is impossible with the prior art to achieve above the cut-off frequency fc.

Embodiment 2

Figure 7:
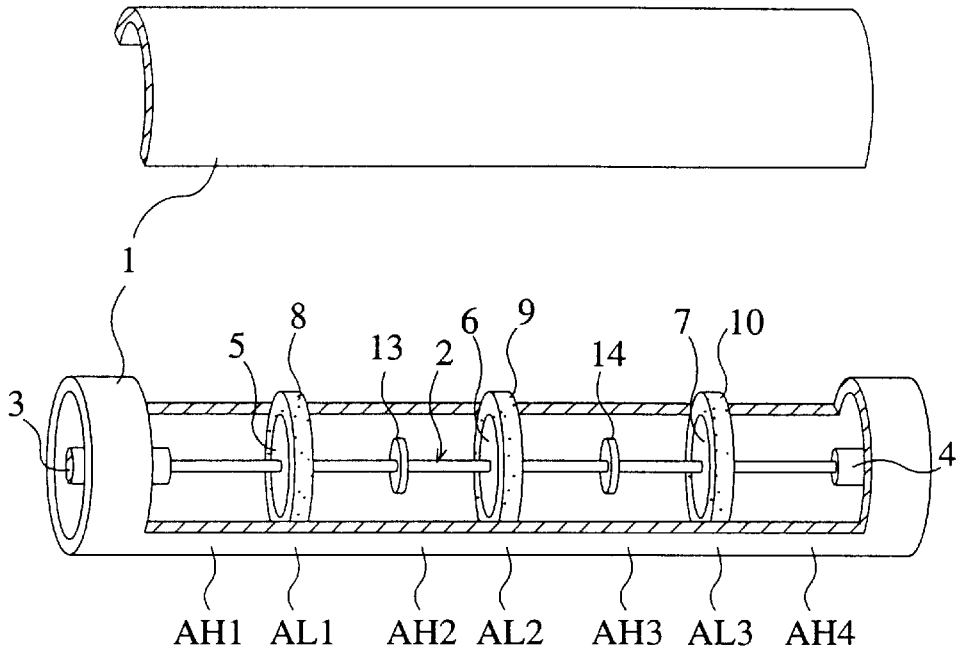
FIG. 7 is a partly exploded, perspective view illustrating the structure of a coaxial line filter according to a second embodiment of the present invention.

FIG. 7 is a partly exploded, perspective view illustrating the configuration of a coaxial line filter (a low-pass filter) according to a second embodiment (Embodiment 2) of the present invention. Reference numerals 13 and 14 denote discs (second capacitive conductors) which are carried upon the signal conductor 2 at mid-points lengthwise thereof in those sections each defined by two capacitive conductors 5 and 6 or 6 and 7. The discs 13 and 14 are smaller than but similar in shape to the capacitive conductors 5, 6 and 7. This embodiment is common in construction to Embodiment 1 except the above. The parts corresponding to those in FIG. 3 are identified by the same reference numerals and characters, and no description will be repeated thereon.

As in the case of Embodiment 1, the discs 13 and 14 cause substantially no variations in the characteristic value at frequencies close to the cut-off frequency fc, and at the frequencies below the cut-off frequency fc the coaxial line filter of this embodiment can also be regarded as having the same characteristic as that of the FIG. 4 equivalent circuit, in disregard of the discs 13 and 14.

Next, the operation of this embodiment will be described below.

When supplied with signals of the VHF, UHF, microwave or milliwave band via the input terminal 3, the coaxial line filter attenuates signals above the cut-off frequency fc that is determined by the LC ladder circuit, and the coaxial line filter permits the passage therethrough of only signals below the cut-off frequency fc for output via the output terminal 4.

And, in Embodiment 2 the high-impedance lines of the pairs (AH1 and AH4, AH2 and AH3) symmetrically located along the signal conductor 2 have the same physical length, and hence they naturally have the same electric length. Accordingly, there is the possibility that resonance occurs between the high-impedance lines at the frequency where the phase of the input signal varies by $\pi$ for the length of one of the high-impedance lines. However, signals of the resonance frequency fs in the high-impedance lines AH1, AH2, AH3 and AH4 are also effectively attenuated by the discs 13 and 14 each mounted on one of the high-impedance lines AH2 and AH3 at the mid-point in the lengthwise direction thereof. Hence, the filter structure of this embodiment suppresses resonance between the high-impedance lines AH1, AH2, AH3 and AH4, making it possible to provide a large attenuation value over a wide frequency band which is impossible with the prior art to achieve above the cut-off frequency fc.

As described above, according to Embodiment 2, since the discs 13 and 14 are geometrically similar to the capacitive conductors 5, 6 and 7, they can be fabricated by common design criteria. This means that the additional provision of the discs 13 and 14 as the second capacitive conductors does not ever require extra time to do so.

Embodiment 3

Figure 8:
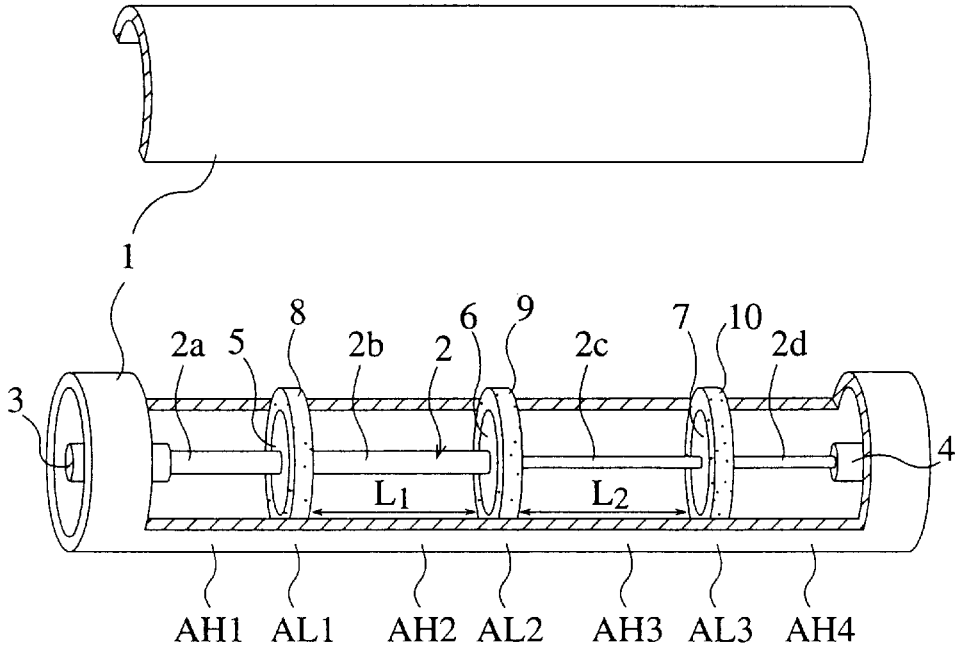
FIG. 8 is a partly exploded, perspective view illustrating the structure of a coaxial line filter according to a third embodiment of the present invention.

FIG. 8 is a partly exploded, perspective view illustrating the configuration of a coaxial line filter (a low-pass filter) according to a third embodiment (Embodiment 3) of the present invention. Reference numerals 2*c* and 2*d* denote standard signal conductor sections which are equal in thickness or diameter (in sectional area) to the signal conductor 2 in Embodiment 1 and have the same length L2. Reference numerals 2*a* and 2*b* denote special signal conductor sections each of which has a thickness or diameter (a sectional area) larger than that of the signal conductor 2 in Embodiment 1 and has a length L1 slightly greater than L2. The special signal conductor sections 2*c* and 2*d* are formed so that their inductance values at the cut-off frequency fc match the inductance values of the standard signal conductor sections 2*a* and 2*b* located in symmetric relation to those 2*c* and 2*d* in the lengthwise direction of the signal conductor 2. Accordingly, an equivalent circuit of this coaxial line filter at the cut-off frequency fc is the same as depicted in FIG. 4. This embodiment is identical in construction to Embodiment 1 except the above. The parts corresponding to those in Embodiment 1 are identified by the same reference numerals and characters, and no particular description will be repeated thereon. With such a structure in which the signal conductor 2 has sections of different thicknesses and lengths chosen such that at a predetermined frequency (at the cut-off frequency fc), they each provide the same inductance value as that in the section located in symmetrical relation thereto, the distance between the signal conductor 2 and the external ground conductor 1 differs for each section, and the characteristic impedance value also differs accordingly.

Next, the operation of this embodiment will be described below.

When supplied with signals of the VHF, UHF, microwave or milliwave band, the coaxial line filter of this embodiment attenuates the signal above the cut-off frequency determined by the LC ladder circuit, and the filter passes therethrough the signal below the cut-off frequency fc and provides it to the output terminal 4.

And, in Embodiment 3 the high-impedance lines of the pairs (AH1 and AH4, AH2 and AH3) symmetrically located along the signal conductor 2 differ in physical length and consequently in electric length as well. Accordingly, the two high-impedance lines of each pair differ (does not overlap each other) in the frequency at which the input signal undergoes the phase variation π for the length of each high-impedance line. That is, the paired high-impedance lines (AH1 and AH4, or AH2 and AH3) do not resonate at the same frequency unlike in the case where they have the same length. Hence, the filter structure of this embodiment suppresses the transmission of signals due to resonance in the high-impedance lines AH1, AH2, AH3 and AH4, making it possible to provide a large attenuation value over a wide frequency band which is impossible with the prior art to achieve above the cut-off frequency fc.

As described above, the coaxial line filter according to Embodiment 3 comprises the ground conductor 1, the signal conductor 2 disposed apart from the ground conductor 1, and the plurality of disc-shaped capacitive conductors 5, 6 and 7 mounted on the signal conductor 2 at predetermined intervals to form between them and the external ground conductor 1 electric fields of higher intensity than that by the signal conductor 1. The signal conductor 2 is thus formed by an alternate arrangement of the high-impedance lines AH1, AH2, AH3 and AH4 defined by the capacitive conductors 5, 6 and 7 therebetween, respectively, and the low-impedance lines AL1, AL2 and AL3 formed by the capacitive conductors 5, 6 and 7, respectively. Because of such a structure, the coaxial line filter of this embodiment effectively attenuates, over a wide frequency band, signals above the cut-off frequency fc that is determined by the alternate arrangement of the high-impedance lines AH1 to AH4 and the low-impedance lines AL1 to AL3.

Besides, the signal conductor 2 forming the two high-impedance lines AH1 and AH2 differ in sectional area from the signal conductor 2 forming the other high-impedance lines AH3 and AH4 which are symmetrical thereto with respect to the center of the signal conductor 2 in its lengthwise direction. Furthermore, the length of the signal conductor 2 forming the high-impedance lines AH1 and AH2 is so chosen as to provide the inductance value in the corresponding high-impedance lines AH3 and AH4 at the cut-off frequency fc.

Hence, the frequency at which the phase of the input signal varies by π for the electric length of each high-impedance line differs for each of the pairs of high-impedance lines AH1–AH2 and AH3–AH4. Even if such high-impedance lines AH1–AH2 and AH3–AH4 of different electric lengths are connected in pairs, no resonance will occur between them. Moreover, even if the signal conductor 2 has a different electric length for only one of the pairs of high-impedance lines, the signal of the resonance frequency fs is surely attenuated in such a pair of high-impedance lines as a whole throughout the signal conductor 2. Accordingly, the filter structure of this embodiment ensures the implementation of a sharp cut-off characteristic at the cut-off frequency fc by providing plural stages of high-impedance lines and, at the same time suppresses the occurrence of resonance between the high-impedance lines, making it possible to provide a large attenuation value over a wide frequency band which is impossible with the prior art to achieve above the cut-off frequency fc.

Embodiment 4

Figure 9:
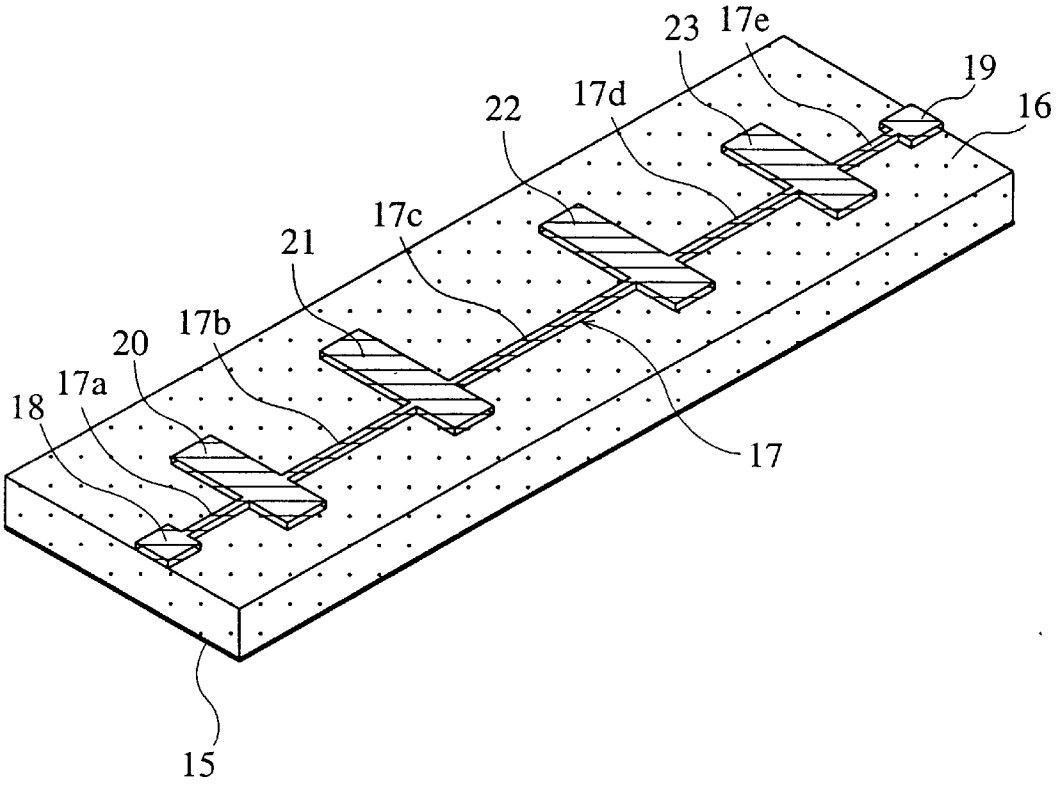
FIG. 9 is a partly exploded, perspective view illustrating the structure of a stripline filter according to a fourth embodiment of the present invention.
Figure 10:
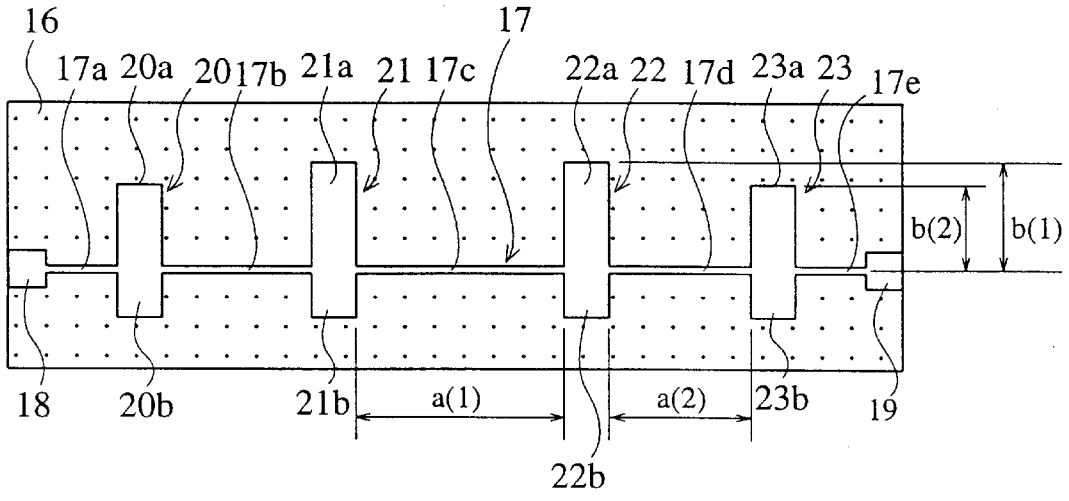
FIG. 10 is a front view depicting the configuration of the stripline filter according to the fourth embodiment.

FIG. 9 illustrates in perspective the configuration of a stripline filter according to a fourth embodiment (Embodiment 4) of the present invention, and FIG. 10 is its front view. Reference numeral 15 denotes a flat ground conductor (a ground conductor); 16 denotes a dielectric plate laminated to the flat ground conductor 15; 17 denotes a signal conductor laminated to the dielectric plate 16; 18 denotes an input terminal laminated on the dielectric plate 16 and connected to one end of the signal conductor 17; 19 denotes an output terminal similarly laminated on the dielectric plate 16 and connected to the other end of the signal conductor 17; and 20, 21, 22 and 23 denote substantially rectangular conductors (capacitive conductors) laminated on the dielectric plate 16 at predetermined intervals along the signal conductor 17 and connected thereto in such a manner as to extend across the signal conductor 17. Those portions of the signal conductor 17 across which the conductors 20, 21, 22 and 23 extend form electric fields between them and the flat ground conductor 16, and hence they serve as low-impedance line sections, and those portions of the signal conductor 17 defined by pairs of capacitive conductors (20 and 21, 21 and 22, 22 and 23) therebetween serve as high-impedance line sections.

And, the capacitive conductors 20 to 23 extend therefrom outwardly of their both sides. Reference numerals 20*a*, 21*a*, 22*a* and 23*a* denote open stub projecting portions which extend from the signal conductor 17 at one side thereof and have electric lengths (b(n)=a(n)/2, where n=, 1, 2, . . . ) equal to one-halves those of the adjoining high-impedance lines 17*b*, 17*c* and 17*d*, respectively. Reference numerals 20*b*, 21*b*, 22*b* and 23*b* denote rearward projections of the capacitive conductors 20, 21, 22 and 23 which project out from the signal conductors 17 at the side opposite to the open stub projecting portions 20*a*, 21*a*, 22*a* and 23*a*, respectively.

Next, the operation of this embodiment will be described below.

When supplied with signals of the VHF, UHF, microwave or milliwave band, the stripline filter of this embodiment operates as an LC ladder circuit formed by the alternate arrangement of the low-impedance and high-impedance line sections, attenuates the signal above the cut-off frequency fc which is determined by the LC ladder circuit configuration, and the filter passes therethrough the signal below the cut-off frequency fc and provides it to an output terminal 19.

In Embodiment 4, the capacitive conductors 20, 21, 22 and 23 formed across the signal conductors 17 consist of the open stub projecting portions 20*a*, 21*a*, 22*a* and 23*a* of electric lengths one-halves those of the adjoining high-impedance lines 17*b*, 17*c* and 17*d* and the rearward projecting portions 20*b* 21*b*, 22*b* and 23*b*. At the frequencies where the phase of the input signal varies by p for the electric lengths of the high-impedance lines 17*b*, 17*c* and 17*d*, the capacitive conductors 20, 21, 22 and 23 are electrically shorted almost completely with the signal conductor 17 at their junctions (more precisely, at the center of their overlapping portions) by the action of the open stub projecting portions 20*a*, 21*a*, 22*a* and 23*a*. Accordingly, even if the high-impedance lines of each pair symmetrically arranged lengthwise of the signal conductor 17 have the same electric length, no resonance will occur between them. That is, the filter structure of this embodiment effectively suppresses resonance between a plurality of high-impedance lines, making it possible to provide a large attenuation value over a wide frequency band which is impossible with the prior art to achieve above the cut-off frequency fc.

As described above, according to Embodiment 4, the stripline filter comprises: the flat ground conductor 15; the signal conductor 17 separated by the dielectric plate 16 from the flat ground conductor 15; and the plurality of rectangular conductors 20, 21 22 and 23 disposed on the signal conductor 17 at predetermined intervals lengthwise thereof. The signal conductor 17 is thus composed of an alternate arrangement of the high-impedance lines 17*b*, 17*c* and 17*d* defined by the rectangular conductors 20, 21, 22 and 23 therebetween, respectively, and the low-impedance lines formed by the conductors 20, 21, 22 and 23, respectively. Because of such a structure, the stripline filter of this embodiment effectively attenuates signals above the cut-off frequency fc that is determined by the alternate arrangement of the high-impedance lines 17*b*, 17*c* and 17*d* and the low-impedance lines.

In addition, the capacitive conductors 20, 21, 22 and 23 formed across the signal conductors 17 consist of the open stub projecting portions 20*a*, 21*a*, 22*a* and 23*a* of electric lengths equal to one-halves those of the adjoining high-impedance lines 17*b*, 17*c* and 17*d* and the rearward projecting portions 20*b* 21*b*, 22*b* and 23*b* which extend from the signal conductor 17 at the side opposite to the open stub projecting portions 20*a*, 21*a*, 22*a* and 23*a*. With such a structure, at the frequencies where the phase of the input signal varies by p for the electric lengths of the high-impedance lines 17*b*, 17*c* and 17*d*, the capacitive conductors 20, 21, 22 and 23 are electrically shorted almost completely with the signal conductor 17 at their junctions by the action of the open stub projecting portions 20*a*, 21*a*, 22*a* and 23*a*. Hence, even if the high-impedance lines of each pair symmetrically arranged lengthwise of the signal conductor 17 have the same electric length, no resonance will occur between them. That is, the stripline filter of this embodiment ensures the implementation of a sharp cut-off characteristic at the cut-off frequency fc by the plurality of high-impedance lines and, at the same time, effectively suppresses resonance between the high-impedance lines, making it possible to provide a large attenuation value over a wide frequency band which is impossible with the prior art to achieve above the cut-off frequency fc.

While in the above the stripline filter has been described to include the single flat ground conductor 15, the same results as mentioned above could be obtained with a tri-plate structure having the signal conductor 17 sandwiched between a pair of flat ground conductors 15.

Embodiment 5

Figure 11:
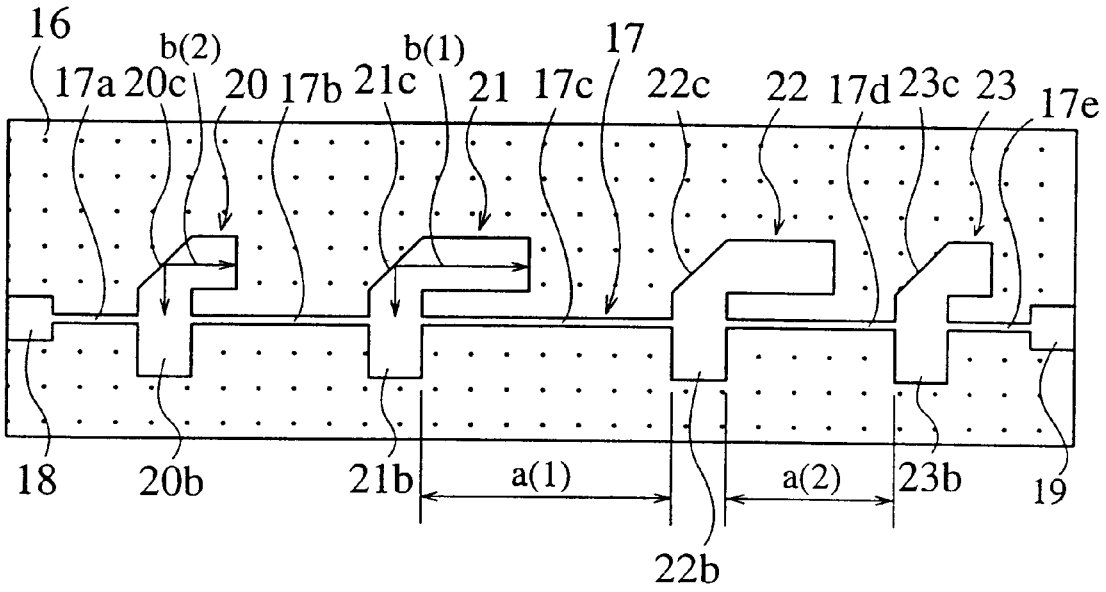
FIG. 11 is a front view illustrating the configuration of a stripline filter according to a fifth embodiment of the present invention.

FIG. 11 is a front view illustrating the configuration of a stripline filter according to a fifth embodiment (Embodiment 5) of the present invention. Reference numerals 20*c*, 21*c*, 22*c* and 23*c* denote bent open stub projecting portions (open stub projecting portions) which have electric lengths (b(n)= a(n)/1, where n=1, 2, . . . ) equal to one-halves those of the adjoining high-impedance lines, respectively. This embodiment is identical in construction except the above. The parts corresponding to those in Embodiment 4 are identified by the same reference numerals, and no description will be repeated thereon.

Next, the operation of this embodiment will be described below.

When supplied with signals of the VHF, UHF, microwave or milliwave band, the stripline filter of this embodiment operates as an LC ladder circuit formed by the alternate arrangement of the low-impedance and high-impedance line sections, and attenuates the signal above the cut-off frequency fc which is determined by the LC ladder circuit configuration, and the filter passes therethrough the signal below the cut-off frequency fc and provides it to an output terminal 19.

In Embodiment 5, the rectangular capacitive conductors 20, 21, 22 and 23 formed across the signal conductors 17 consist of the open stub projecting portions 20*a*, 21*a*, 22*a* and 23*a*of electric lengths equal to one-halves those of the adjoining high-impedance lines 17*b*, 17*c* and 17*d* and the rearward projections 20*b* 21*b*, 22*b* and 23*b*, respectively. At the frequencies where the phase of the input signal varies by p for the electric lengths of the high-impedance lines 17*b*, 17*c* and 17*d*, the capacitive conductors 20, 21, 22 and 23 are electrically shorted almost completely with the signal conductor 17 at their junctions by the action of the bent open stub projecting portions 20*c*, 21*c*, 22*c* and 23*c*. Accordingly, even if the high-impedance lines of each pair symmetrically arranged on the signal conductor 17 lengthwise thereof have the same electric length, no resonance will occur between them. That is, the filter structure of this embodiment effectively suppresses the occurrence of resonance between the high-impedance lines, making it possible to provide a large attenuation value over a wide frequency band which is impossible with the prior art to achieve above the cut-off frequency fc.

As described above, according to Embodiment 5, since the open stub projecting portions 20*c*, 21*c*, 22*c* and 23*c* are bent, they are small in area, permitting miniaturization or downsizing of the stripline filter accordingly.

While in the above only the open stub projecting portions 20*c*, 21*c*, 22*c* and 23*c* have been described to be bent, the rearward projecting portions 20*b*, 21*b*, 22*b* and 23*b* may also be bent. Further, these projecting portions may be bent twice or more.

Effect of the Invention

As will be appreciated from the above, the low-pass filter according to the present invention ensures the provision of a sharp cut-off characteristic by two or more stages of high-impedance lines and, at the same time, suppresses the occurrence of resonance between them, achieving a large attenuation value over a wide frequency range above the cut-off frequency. Hence, the low-pass filter of the present invention is suitable for use in attenuating high-frequency components in the VHF, UHF, microwave and milliwave bands.

It will be apparent that many modifications and variations may be effected without departing from the scope of the novel concepts of the present invention.

What is claimed is:

1. A low-pass filter comprising:

a ground conductor;

a signal conductor disposed in said ground conductor but spaced apart therefrom;

a plurality of first capacitive conductors mounted on said signal conductor at predetermined intervals lengthwise thereof to form electric fields higher in intensity than that of said signal conductor between said capacitive conductors and said ground conductor, said plurality of first capacitive conductors forming low-impedance lines, respectively, and defining a high-impedance line between each pair of first said capacitive conductors so that said signal conductor is composed of an alternate arrangement of said low-impedance and high-impedance lines; and second capacitive conductors each carried upon said signal conductor in one of said high-impedance lines at the mid-point in its lengthwise direction to form between it and said ground conductor (an electric field of an intensity lower than that formed by each of said first capacitive conductors).

2. The low-pass filter according to claim 1, wherein said second capacitive conductors are geometrically similar to said first capacitive conductors.

3. A low-pass filter comprising:

a ground conductor;

a signal conductor disposed in said ground conductor but spaced apart therefrom; and a plurality of capacitive conductors mounted on said signal conductor at predetermined intervals lengthwise thereof to form electric fields higher in intensity than that of said signal conductor between said capacitive conductors and said ground conductor, said plurality of capacitive conductors forming low-impedance lines, respectively, and defining a high-impedance line between each pair of said capacitive conductors so that said signal conductor is composed of an alternate arrangement of said low-impedance and high-impedance lines;

wherein: that part of said signal conductor forming at least one of said high-impedance lines has a sectional area different from those of the other parts of said signal conductor forming the other remaining high-impedance lines; and when said sectional area of said part of said signal conductor forming said at least one high-impedance line differs from the sectional area of that part of said signal conductor forming that one of said remaining high-impedance lines located in symmetrical relation to said at least one high-impedance line with respect to the center of said signal conductor, the length of said part of said signal conductor having said at least one high-impedance line is chosen such that said signal conductor provides the same inductance value at a cut-off frequency in said symmetrically located high-impedance lines.

4. A low-pass filter comprising:

a flat ground conductor;

a signal conductor spaced apart from said ground conductor; and a plurality of capacitive conductors mounted on said signal conductor at predetermined intervals lengthwise thereof, said plurality of capacitive conductors forming low-impedance lines, respectively, and defining a high-impedance line between each pair of said capacitive conductors so that said signal conductor is composed of an alternate arrangement of said low-impedance and high-impedance lines;

wherein said plurality of capacitive conductors are each composed of an open stub projecting portion of an electric length equal to one-half that of the adjoining one of said high-impedance lines and a rearward projection extending from said signal conductor at the side opposite to said open stub projecting portion.

5. The low-pass filter according to claim 4, wherein said open stub projecting portion and/or said rearward projection is bent.

* * * * *